US007753197B2

(12) United States Patent
Russell

(10) Patent No.: US 7,753,197 B2
(45) Date of Patent: Jul. 13, 2010

(54) COVER MEMBER SUITABLE FOR RECEIVING A RAZOR; KIT INCLUDING SAID COVER MEMBER, RAZOR AND A CONTAINER

(75) Inventor: Rachel Russell, Hull (GB)

(73) Assignee: Reckitt Benckiser (UK) Limited, Berkshire (GB)

( * ) Notice: Subject to any disclaimer, the term of this patent is extended or adjusted under 35 U.S.C. 154(b) by 49 days.

(21) Appl. No.: 12/083,987

(22) PCT Filed: Oct. 25, 2006

(86) PCT No.: PCT/GB2006/003966

§ 371 (c)(1),
(2), (4) Date: Aug. 6, 2008

(87) PCT Pub. No.: WO2007/049031

PCT Pub. Date: May 3, 2007

(65) Prior Publication Data

US 2009/0159469 A1 Jun. 25, 2009

(30) Foreign Application Priority Data

Oct. 26, 2005 (GB) ..... 0521828.4

(51) Int. Cl.
*B65D 69/00* (2006.01)
*A45C 11/26* (2006.01)
*A45D 27/22* (2006.01)

(52) U.S. Cl. ..... 206/228; 132/289; 206/352; 206/581

(58) Field of Classification Search ..... 206/228, 206/229, 352–356, 581; 132/286–289; 220/521–522, 220/735–736
See application file for complete search history.

(56) References Cited

U.S. PATENT DOCUMENTS 2,465,752 A * 3/1949 Rodbell ..... 220/522
2,738,900 A * 3/1956 Wenger ..... 220/735
3,272,323 A * 9/1966 Ewry ..... 206/229
4,141,445 A 2/1979 Korich (Continued)

FOREIGN PATENT DOCUMENTS

FR 2 428 992 A 1/1980

(Continued)

OTHER PUBLICATIONS

PCT International Search Report and Written Opinion, PCT/GB2006/003966 dated Jan. 15, 2007.

(Continued)

*Primary Examiner*—Bryon P Gehman
(74) *Attorney, Agent, or Firm*—Troutman Sanders LLP; Ryan A. Schneider; Michael J. Brignati

(57) ABSTRACT

A cover member (1) for a container which includes a cap portion (2) and a leg member (3) depending from the cap portion, wherein the leg member has an internal surface arranged to face the container and an external surface which is visable when then the cover member is in use, the cover member further including one or more lugs (4*a*, 4*b*) arranged on the internal surface of the leg member, the one or more lugs being arranged to receive a hair removal tool.

19 Claims, 3 Drawing Sheets

U.S. PATENT DOCUMENTS

| | | | | |
|---|---|---|---|---|
| 4,232,785 | A * | 11/1980 | Lucas | 206/228 |
| 4,320,832 | A * | 3/1982 | Edstrom | 206/228 |
| 4,695,029 | A * | 9/1987 | Fox et al. | 248/682 |
| 5,018,543 | A | 5/1991 | Trillo Martinez | |
| 6,179,259 | B1 * | 1/2001 | Schioldager | 206/228 |
| 6,354,433 | B1 | 3/2002 | Mattes | |
| 6,598,609 | B2 * | 7/2003 | Gibbs | 132/289 |
| 7,172,069 | B2 * | 2/2007 | Coffin et al. | 206/352 |
| 2003/0200619 | A1 * | 10/2003 | Kelsey et al. | 15/236.01 |

FOREIGN PATENT DOCUMENTS

| | | | |
|---|---|---|---|
| FR | 2 733 882 | A | 11/1996 |
| WO | WO 2007/049031 | A1 | 5/2007 |

OTHER PUBLICATIONS

Combined Search and Examination Report under Sections 17 and 18(3), dated Jan. 9, 2006, 3 pages.

* cited by examiner

COVER MEMBER SUITABLE FOR RECEIVING A RAZOR; KIT INCLUDING SAID COVER MEMBER, RAZOR AND A CONTAINER

BACKGROUND OF THE INVENTION (1) Field of the Invention

The present invention is concerned with a cover member for a container.

(2) Description of Related Art

Aerosol or pump type cylindrical containers are often used for storage of cosmetic products, such as creams, gels or foams. Such cosmetic products are often used in combination with a tool. For example depilatory compositions are typically used together with a spatula or scraper device, whereas shaving aid compositions (such as shaving gels) are often used together with a razor.

Hair removal tools are often sold together with and therefore packaged with a cosmetic composition. However, such packaging is typically secondary packaging designed for the point of sale, therefore once the consumer has purchased the product and opened the secondary packaging the tool and the container containing the cosmetic composition become separated. This can be disadvantageous as the tool can often become misplaced. In addition, it is often not aesthetically pleasing to a consumer to have the hair removal tool simply positioned next to the container.

It is therefore an object of the present invention to alleviate at least some of the disadvantages listed above.

It is a further aim of the present invention to provide a cover member for a container.

BRIEF SUMMARY OF THE INVENTION

Therefore, according to a first aspect of the present invention there is provided a cover member for a container which includes a cap portion and a leg member depending from the cap portion, wherein the leg member has an internal surface arranged to face the container and an external surface which is visable when then the cap is in use, the cover member further including one or more lugs arranged on the internal surface of the leg member, the lugs being arranged to receive a hair removal tool.

The present invention is particularly advantageous as the lugs hold a depilatory tool in position (during, for example, storage or transportation) whilst keeping hidden prior to use.

Preferably, the cover member includes at least two lugs. Each lug may be arranged to receive a handle portion of a hair removal tool.

It is envisaged that the hair removal tool may be a tool, for example a spatula or the like suitable for use in removal of a depilatory composition (such as a gel, cream or foam). Typically, the hair removal tool includes a head portion having a curved scraping edge arranged to contact a users skin thereby removing the depilatory composition. It is particularly preferred that the spatula comprises a handle connected to a head portion wherein the head includes one or more fins extending away from the head.

Alternatively, the hair removal tool may include one or more blades, such as a razor blade. Typically the hair removal tool will therefore include a handle and a head portion, wherein the head portion includes the one or more blades.

It is therefore particularly preferred that the hair removal tool includes a head portion separated from a handle by a neck portion. Advantageously, the lugs are arranged to receive, and therefore removably retain, the hair removal tool at the neck portion.

It is preferred that the cap portion is hemispherical or a truncated cone, however it is envisaged that other shapes may be used.

The cover member may be manufactured from a metal such as aluminium, however, it is preferred that the cover member is manufactured from a plastics material such as polyethylene or polypropylene. Therefore, it is preferred that the cover member is manufactured by an injection moulding process.

Advantageously, the cap portion further includes one or more protrusions arranged to releasably engage the cover member with a container (such as a container for a cosmetic composition). The protrusions are typically arranged in a radial orientation extending inwardly from an outer edge of the cap portion.

According to a further aspect of the present invention there is provided a kit for a cosmetic composition, wherein the kit includes:

a container arranged to receive a cosmetic composition;

a hair removal tool; and a cover member for the container wherein the cover member includes a cap portion and a leg member depending from the cap portion, the cover member including one or more lugs arranged to receive the hair removal tool.

The cover member is typically removable from the container.

Preferably the cover member and/or the hair removal tool is substantially as described hereinbefore.

The container may preferably be a cylindrical container however other shaped containers are envisaged.

It is particularly desirable that the cover member includes a protrusion which is arranged to engage with a lip portion on the container, thereby permitting the cover member to be removably attached to the container.

BRIEF DESCRIPTION OF THE DRAWINGS

The present invention will now be described by way of example only, with reference to the accompanying figures wherein.

DETAILED DESCRIPTION OF THE INVENTION

Figure 1:
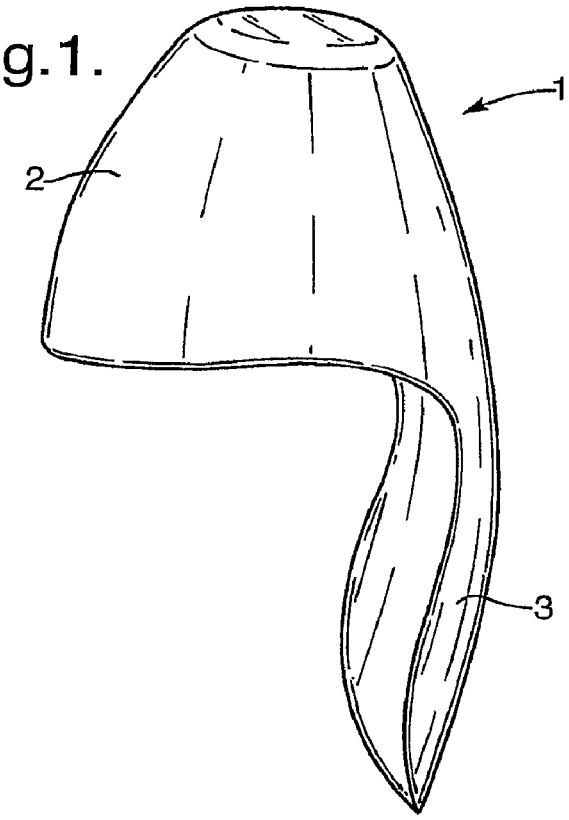
FIG. 1 is a front perspective view of a cover member according to the present invention.
Figure 2:
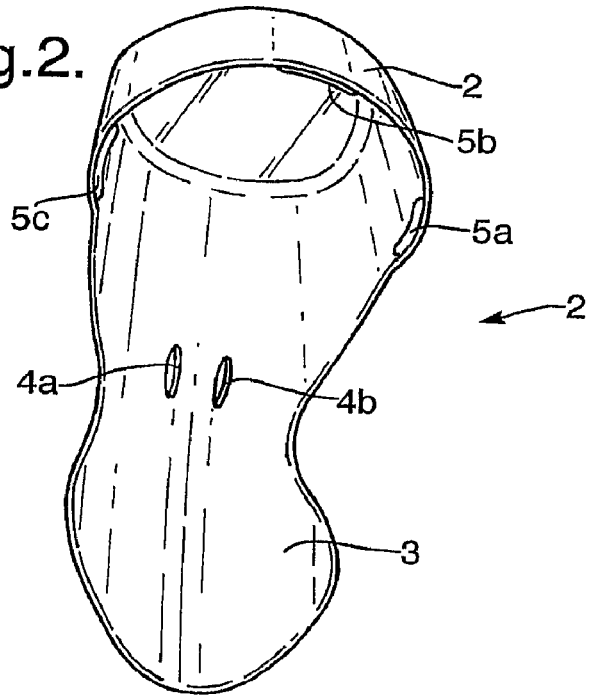
FIG. 2 is a perspective view from below of a cover member according to the present invention.

Referring to FIGS. 1 and 2 where like numerals have been used to identify like parts, there is provided a cover member 1. The cover member includes a cap portion 2 and a leg 3. Lugs 4*a* and 4*b* are formed integrally with leg 3. Protrusions 5*a*, 5*b* and 5*c* are formed integrally with cap portion 2 of cover member 1.

In use, the lugs 4*a* and 4*b* grip the neck of a hair removal tool thereby containing the hair removal tool within the cover member. The lugs 4*a* and 4*b* permit a hair removal tool to be releasably engaged.

Figure 3:
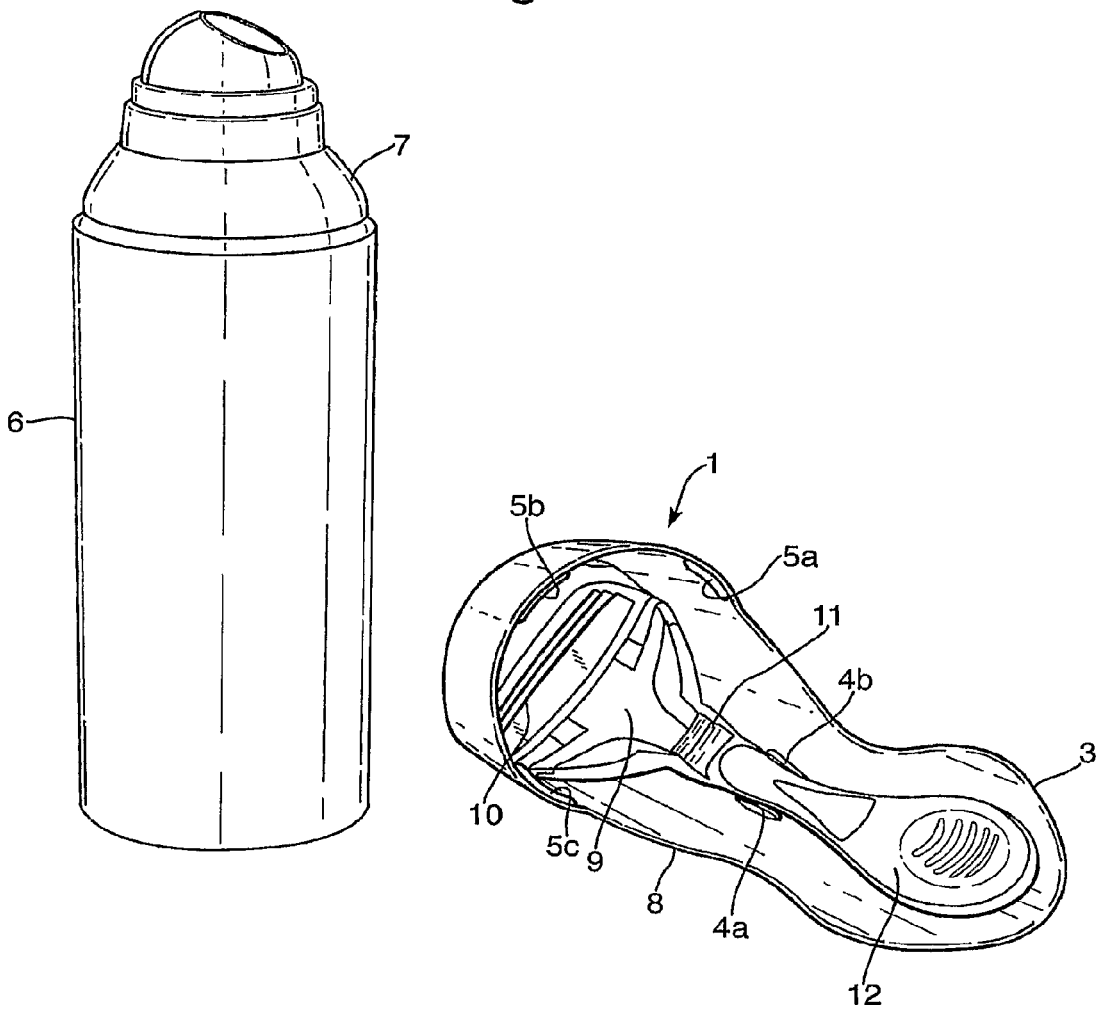
FIG. 3 is a front view of the kit according to the present invention with the cover member removed from the container.
Figure 4:
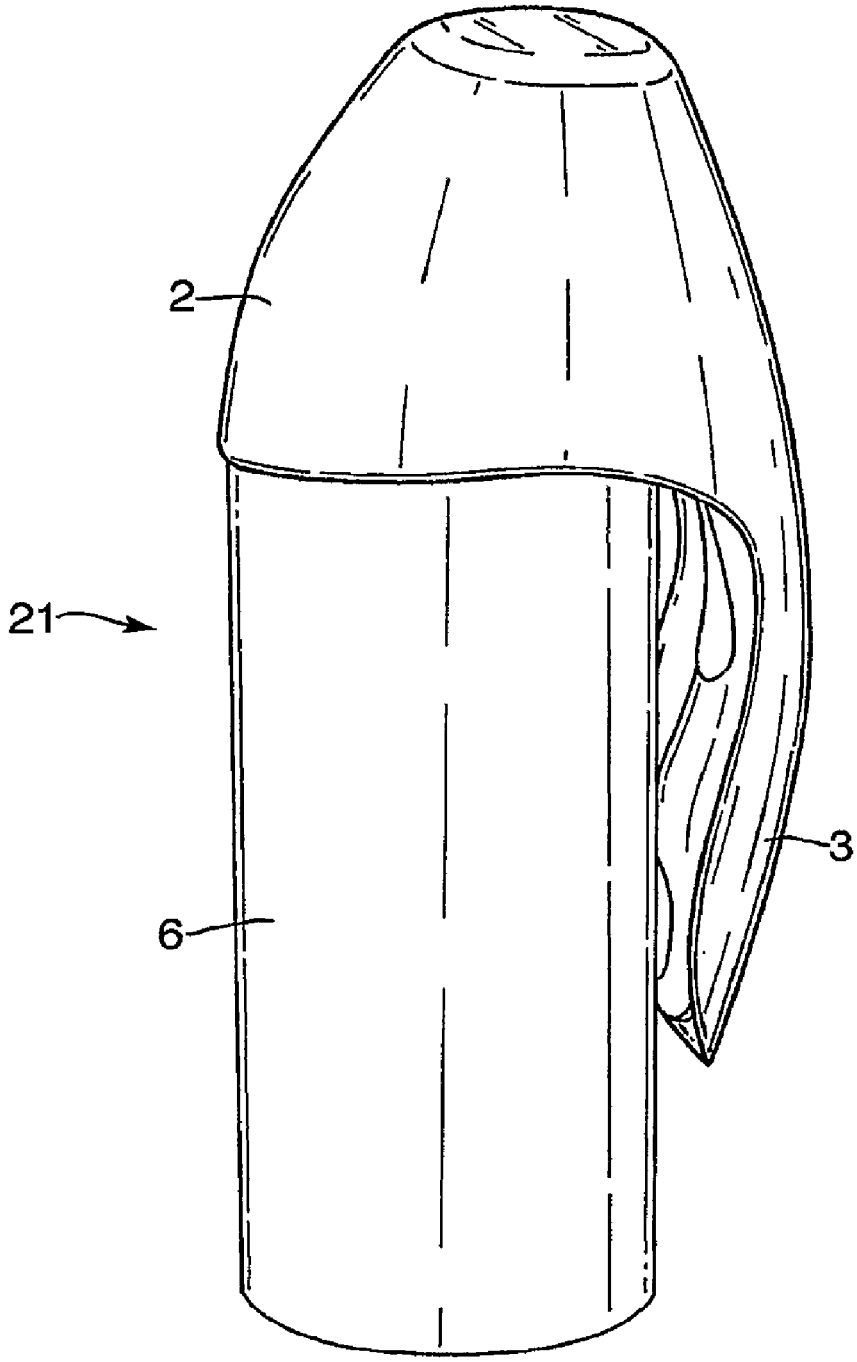
FIG. 4 is a front view of the kit according to the present invention with the cover member engaged with the container.

Referring to FIGS. 3 and 4, where like numerals have been used to identify like parts shown in FIGS. 1 and 2, there is shown a kit 21 according to the present invention. The container 6 has a lip 7 thereon arranged to engage with protrusions 5*a*, 5*b* and 5*c* on cover member 1.

A hair removal spatula 3 which comprises a head portion 9 (having a scraping edge 10), a neck 11 and a handle 12 is releasably held by lugs 4*a* and 4*b* at the neck 11.

In assembled form, the spatula 8 is held in place in the cover member 1 by lugs 4*a* and 4*b*. Cover member 1 is placed on container 6 and realisably held in place by engagement of lip 7 with protrusions 5*a*, 5*b* and 5*c*.

The invention claimed is:

1. A cover member for a container, the cover member comprising:

a cap portion having a top element and a wall element extending downward from a perimeter of the top element so that the cap portion is configured to cover at least a top portion of the container;

a leg member extending from the cap portion; and one or more lugs disposed on the leg member;

wherein the leg member downwardly extends from a portion of the wall element of the cap portion, the leg member having an internal surface arranged to face the container and an external surface which is visible when the cover member is in use, and, wherein the one or more lugs are inwardly facing and arranged on the internal surface of the leg member, the one or more lugs being arranged to releasably hold a hair removal tool.

2. A cover member according to claim 1, wherein the one or more lugs comprises at least two lugs.

3. A cover member according to claim 1, wherein each lug is arranged to receive a handle portion of a hair removal tool.

4. A cover member according to claim 1, wherein the cap portion is hemispherical or a truncated cone.

5. A cover member according to claim 1, wherein the wall element of the cap portion comprises one or more protrusions arranged to releasably engage the cover member with a container.

6. A cover member according to claim 5, wherein the protrusions are arranged in a radial orientation extending inwardly from an outer edge of the cap portion.

7. A kit for a cosmetic composition, wherein the kit includes:

a container arranged to receive a cosmetic composition;

a hair removal tool; and a cover member for the container, the cover member comprising:

a cap portion having a top element and a wall element extending downward from a perimeter of the top element so that the cap portion is configured to cover at least a top portion of the container;

a leg member extending from the cap portion; and one or more lugs disposed on the leg member;

wherein the cap portion comprises a top element and a wall element extending downward from a perimeter of the top element so that the cap portion is configured to cover at least a top portion of the container, and wherein the leg member downwardly extends from a portion of the wall element of the cap portion, the leg member having an internal surface arranged to face the container and an external surface which is visible when the cover member is in use, and, wherein the one or more lugs are inwardly facing and arranged on the internal surface of the leg member, the one or more lugs being arranged to releasably hold the hair removal tool.

8. A kit according to claim 7, wherein the cover member is removable from the container.

9. A kit according to claim 8, wherein the cover member includes a protrusion which is arranged to engage with a lip portion of the container, thereby permitting the cover member to be removably attached to the container.

10. The kit of claim 8, wherein the hair removal tool is a razor that includes a neck, a handle, and a head portion having at least one blade.

11. The kit of claim 10, wherein the container is arranged to receive a shaving aid.

12. The kit of claim 11, wherein the cover member includes a protrusion arranged to engage with a lip portion of the container, thereby permitting the cover member to be removably attached to the container.

13. The kit of claim 8, wherein the hair removal tool is a depilatory composition spatula that includes a head portion having at least one scraping edge, a neck, and a handle.

14. The kit of claim 13, wherein the container is arranged to receive a depilatory composition.

15. The kit of claim 14, wherein the cover member includes a protrusion arranged to engage with a lip portion of the container, thereby permitting the cover member to be removably attached to the container.

16. A kit according to claim 7, wherein the hair removal tool is a razor which includes a neck, a handle and a head portion having at least one blade.

17. A kit according to claim 16, wherein the container is arranged to receive a shaving aid.

18. A kit according to claim 7, wherein the hair removal tool is a depilatory composition spatula which includes a head portion having at least one scraping edge, a neck and a handle.

19. A kit according to claim 18, wherein the container is arranged to receive a depilatory composition.

* * * * *